US005232265A

United States Patent [19]

Estkowski et al.

[11] Patent Number: 5,232,265

[45] Date of Patent: Aug. 3, 1993

[54] VERTICAL BACK ADJUST FOR CHAIRS

[75] Inventors: Michael H. Estkowski; Christopher G. Estkowski, both of St. Joseph, Mich.

[73] Assignee: Shepherd Products U.S., Inc., St. Joseph, Mich.

[21] Appl. No.: 834,692

[22] Filed: Feb. 11, 1992

[51] Int. Cl.[5] ..... B60N 2/02

[52] U.S. Cl. ..... 297/353; 297/410; 403/59; 248/245.1

[58] Field of Search ..... 297/353, 284.7, 410, 297/358, 301; 403/59, 60, 61, 330; 248/231.3, 295.1, 293

[56] References Cited

U.S. PATENT DOCUMENTS

| | | | |
|---|---|---|---|
| 3,526,430 | 9/1970 | Eldon | 297/353 |
| 4,111,484 | 9/1978 | Jaeger | 297/410 |
| 4,128,274 | 12/1978 | Schmedemann | 297/410 |
| 4,191,423 | 3/1980 | Goldner | 297/410 |
| 4,221,430 | 9/1980 | Frobose . | |
| 4,432,582 | 2/1984 | Wiesmann | 297/353 |
| 4,451,084 | 5/1984 | Seeley . | |
| 4,660,885 | 4/1987 | Suhr | 297/353 |
| 4,662,682 | 5/1987 | Maurel | 297/353 |
| 4,749,230 | 6/1988 | Tornero . | |
| 5,035,466 | 7/1991 | Mathews | 297/353 |

FOREIGN PATENT DOCUMENTS

| | | | |
|---|---|---|---|
| 2308483 | 2/1973 | Fed. Rep. of Germany | 297/353 |

*Primary Examiner*—Peter M. Cuomo
*Assistant Examiner*—Flemming Saether
*Attorney, Agent, or Firm*—Lee, Mann, Smith, McWilliams, Sweeney & Ohlson

[57] ABSTRACT

A mechanism for vertical adjustability and securement of a backrest of a chair on the upright support of the chair having a housing which includes first and second housing members, and a pair of link assemblies, pivotally connected and movable between a locked position and an unlocked position. A resilient sleeve is carried by one of the link assemblies and is engageable against the upright support when the link assemblies are in the locked position to grip the upright support between the sleeve and a rod to prohibit vertical movement of the housing with respect to the upright support.

9 Claims, 3 Drawing Sheets

VERTICAL BACK ADJUST FOR CHAIRS

BACKGROUND OF THE INVENTION

Office chairs normally include a vertical adjustment for the chair backrest. Such back adjust devices allow for limited movement of the backrest up and down on the back upright of a chair. Many such devices are difficult to operate as it often requires the release of a locking pin secured within a notched slot or similar arrangement in which a pin must be disengaged and engaged in the notches of the slot. These arrangements provide for a limited number of preset backrest positions. The present invention provides a mechanism for easy vertical adjustment and securement of a chair backrest and allows placement of the backrest in an infinite number of positions.

SUMMARY OF THE INVENTION

The present invention provides a mechanism for vertical adjustability and securement of a chair backrest which allows for easy adjustability of the backrest in an infinite number of positions on the back upright of a chair. The mechanism is operative by tilting the cushion of the backrest which unlocks the housing and permits relocation and locking of the backrest at the desired vertical height. The adjustment mechanism includes a housing which has first and second members pivotally attached to each other. First and second link assemblies are located within the housing and pivotally connected to each other and movable between a locked position and an unlocked position. A resilient sleeve member is nonrotatably carried by the second link assembly and a rod is carried by the first link assembly and spaced apart from the sleeve member to define a gap between the sleeve member and the rod. The upright support passes through this and, when the housing is in the locked position, is squeezed between the sleeve and the rod. A bracket is pivotally connected to the second housing member to connect the second housing member to the chair backrest. A resilient biasing means is connected between the first link assembly and the second link assembly to urge the first and second link assemblies to assume the locked position. The bracket includes a stop means which is engageable with the first housing member.

DETAILED DESCRIPTION OF THE PREFERRED EMBODIMENT

Figure 2:
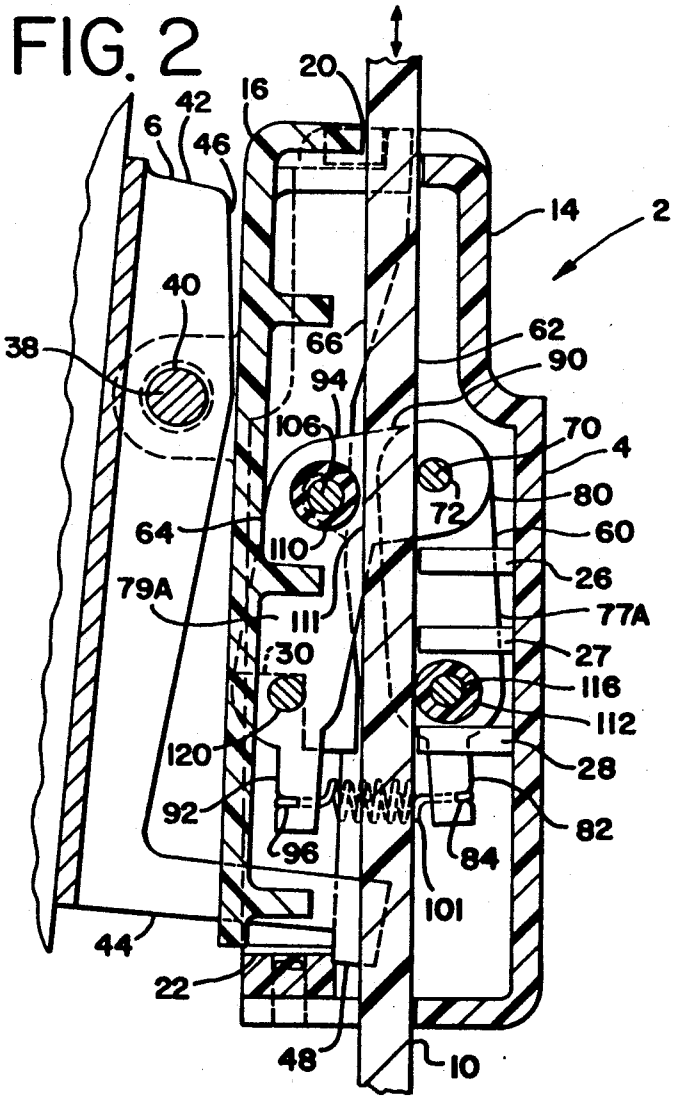
FIG. 2 is a side view in partial cross-section of the mechanism of the present invention in the unlocked position.
Figure 1:
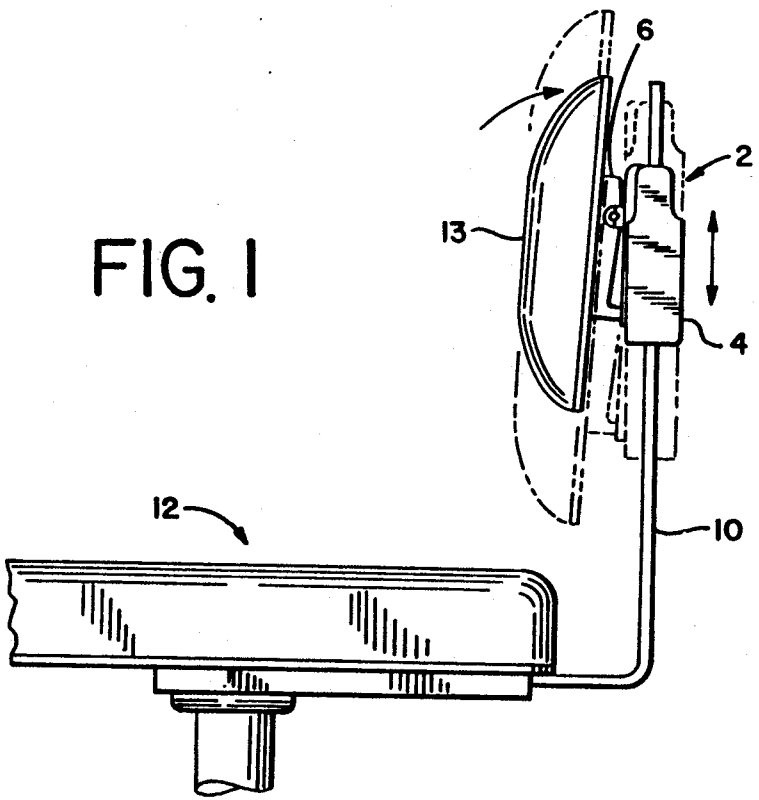
FIG. 1 is a partial side view of a chair including the mechanism of the present invention.

As best seen in FIG. 1, the mechanism 2 has a housing 4 with a bracket 6 attached thereto disposed on an upright support 10 of a chair 12. A backrest 13 is attached to the bracket 6. As best seen in FIG. 2, the housing 4 includes a first member 14 and a second member 16 pivotally attached to each other at the upper end. A gap 20 is provided between the first and second members extending the entire height of the housing through which the upright support 10 of chair 12 passes. The first housing member 14 includes a stop member 22 disposed at the bottom end, opposite the pivotal end thereof, and a plurality of ribs 26, 27 and 28. These ribs 26, 27 and 28 insure proper location of the assembly components to be described later. The second housing member 16 includes an alignment slot 30, shown in phantom in FIG. 2 and a sloped recess 32 shown in FIGS. 4 and 5 in the second housing member 16.

Figure 4:
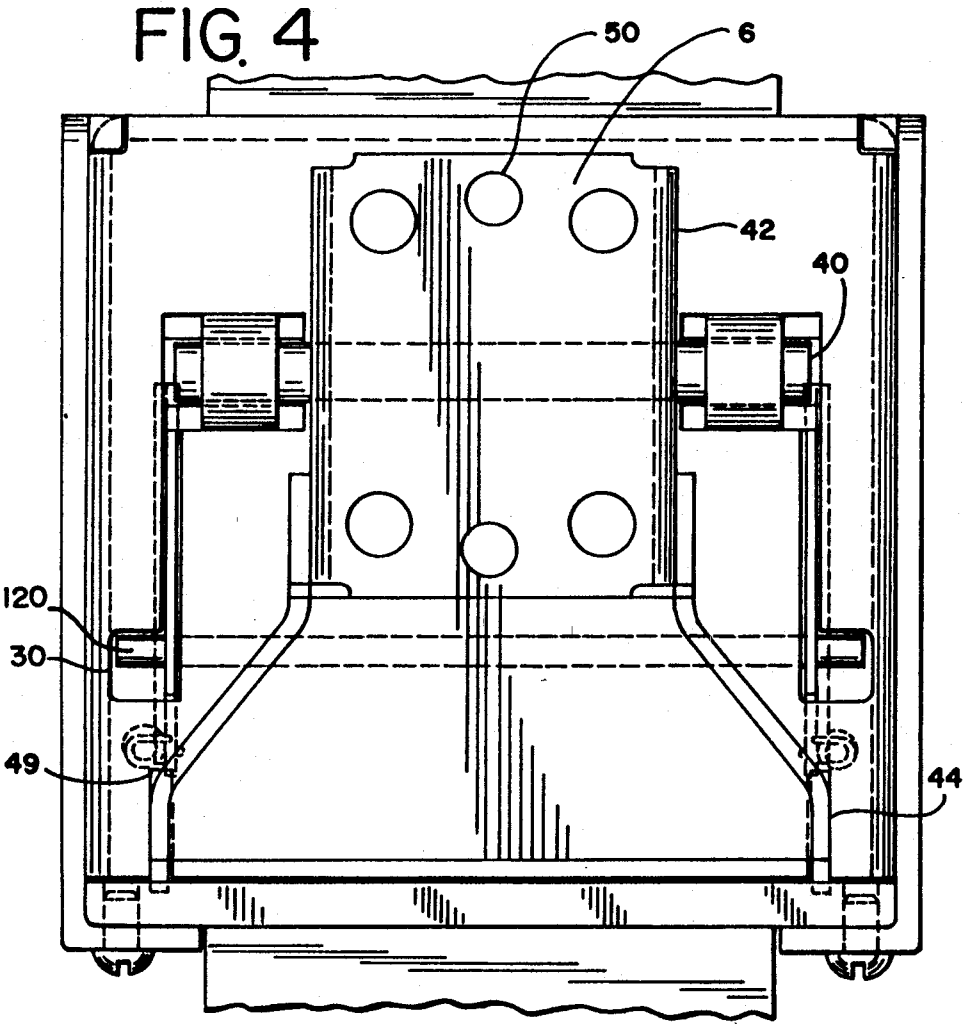
FIG. 4 is an end view of the exterior of the mechanism of the present invention taken along line 4—4 of FIG. 3.

The bracket, 6 best illustrated in FIG. 4, is attached to the second housing member 16 at a pivot point 38 by a pin 40. The bracket 6 includes a first end 42 and a second end 44. The first end 42 of the bracket 6 includes a member 46. The second end 44 of the bracket 6 includes a pair of stop feet 48 adapted to extend through a pair of slots 49, shown in FIG. 4, in the second housing member 16. Rotating the bracket 6 in a clockwise direction about pivot point 38 as viewed in FIG. 2 will result in rotational movement only until the feet 48 engage the stop member 22 of the first housing member 14 as shown in FIG. 2. This stop action prevents the member 46 from contacting the second housing member 16. The bracket 6 additionally includes a plurality of apertures 50, as best seen in FIG. 4, for attachment of the backrest 13 to the bracket 6.

Figure 3:
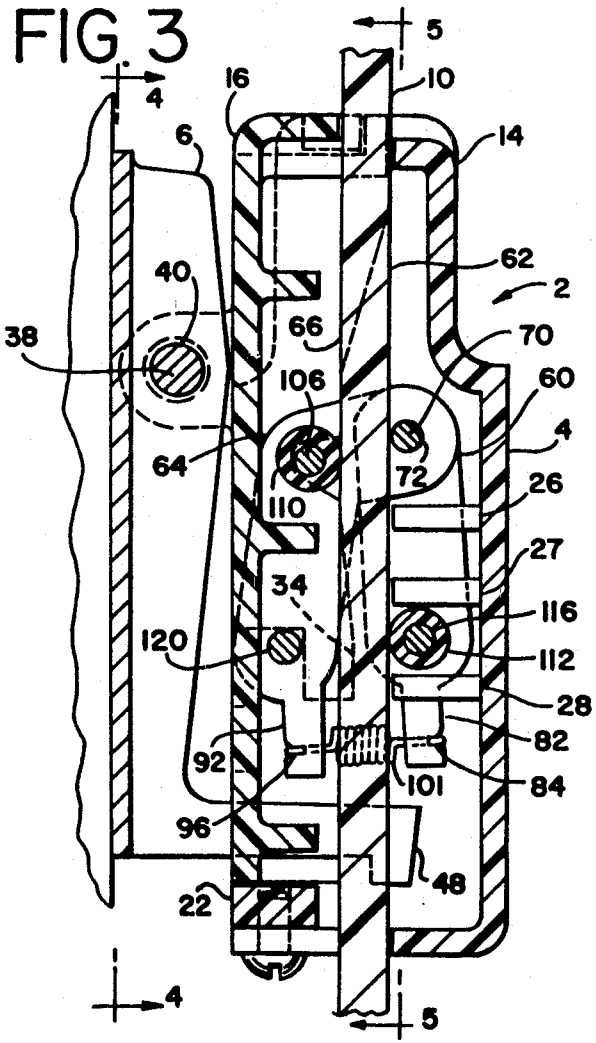
FIG. 3 is a side view in partial cross-section of the mechanism of the present invention in the locked position.

A first link assembly 60 is disposed in the housing 4 on a first side 62 of the upright support 10. A second link assembly 64 is disposed in the housing 4 on a second side 66 of the upright support 10. The second link assembly 64 is pivotally connected to the first link assembly 60 at a pivotal connection 70 by a rod 72. The first and second link assemblies 60 and 64 are movable between a locked position, as best shown in FIG. 3, and an unlocked position as best shown in FIG. 2.

Figure 5:
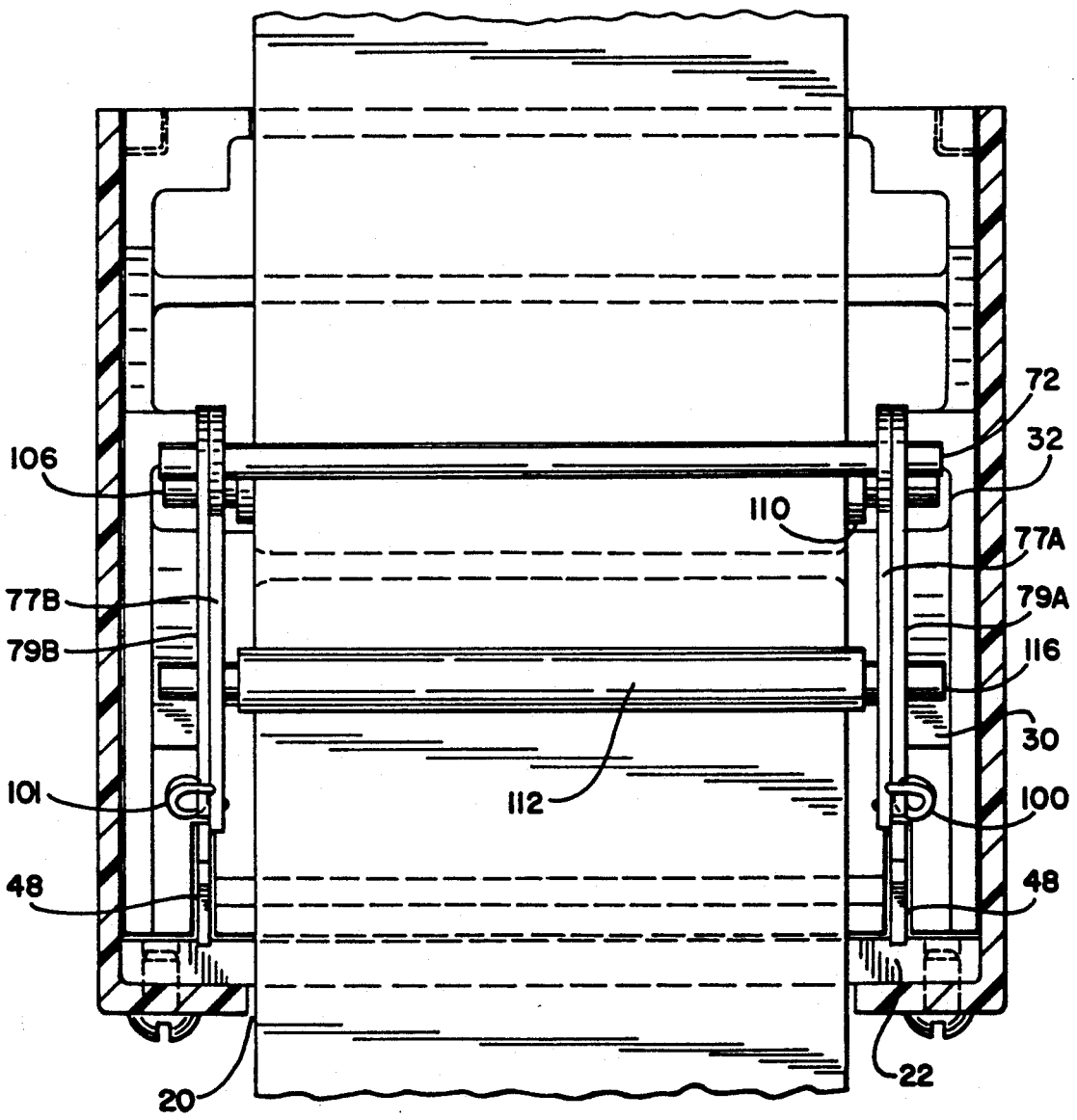
FIG. 5 is an end view in partial cross-section of the mechanism of the present invention taken along line 5—5 of FIG. 3.

The first link assembly 60 includes a pair of links 77A and 77B which are spaced apart and disposed parallel to each other as best seen in FIG. 5. Links 77A and 77B each include a pivotal end 80 and a tensioning end 82 disposed opposite thereto. The tensioning end 82 of each link 77A and 77B includes a notch 84. The second link assembly 64 includes links 79A and 79B which are spaced apart and disposed parallel to each other, as best seen in FIG. 5. Links 79A and 79B each include a pivotal end 90, a tensioning end 92 and a central portion 94 disposed therebetween and are generally L-shaped in configuration. The tensioning end 92 of each link 79A and 79B includes a notch 96.

A tension spring 100 is connected between the links 77A and 79A at the tension ends 82 and 92 in the notches 84 and 96. A spring 101 similarly connects links 77B and 79B to provide a biasing means to urge the first and second link assemblies 60 and 64 to assume the locked position of FIG. 3.

A grooved rod 106 extends between and through the links 79A and 79B of the second link assembly 64 at the central portion 94 thereof and is nonrotatable with respect thereto. The grooved rod 106 is positioned on the second side 66 of the upright support 10 opposite the rod 72. The grooved rod 106 is adapted to sit in the sloped recess 32 in the second housing member 16 when the link assemblies 60 and 64 are in the locked position. The sloped recess 32 allows for unobstructed movement of the ends of the grooved rod 106 when the link assemblies 60 and 64 are moved from the locked position to the unlocked position. A resilient sleeve member 110 is nonrotatably carried by the grooved rod 106. A gap 111 is formed between the rod 72 and the sleeve member 110 to allow for passage of the upright support 10 therethrough. The sleeve member 10 is engageable against the second side 66 of the upright support 10 when the first and second link assemblies 60 and 64 are in the locked position to squeeze the support 10 between the sleeve 110 and the rod 72 to prohibit vertical movement of the housing 4 with respect to the upright support 10.

A roller 112 is disposed between links 77A and 77B of the first link assembly 60 on a rod 116 at the first side 62 of the upright support 10. The roller 112 provides for easy vertical adjustability of the housing 4 and backrest 13 with respect to the upright support 10 when the housing is in the unlocked position.

An alignment pin 120 extends between and through the links 79A and 79B of the second link assembly 64 on the second side 66 of the upright support 10 opposite the roller 112. The alignment pin 120 is adapted to engage the alignment slot 30 in the second housing member 16 to provide for movement of the second link assembly 64 when the second housing member 16 is pivoted with respect to the first housing member 14.

In operation, when adjustment of the vertical position of the backrest is desired, the backrest 13 of chair 12 is grasped by a user, preferably with one hand on either side thereof, and the backrest is pulled away from the upright support 10. The pin 40 becomes the force applying member and causes pivotal movement of the bottom of the second housing member 16 away from the first housing member 14. As the second housing member 16 pivots, the second link assembly 64 attached thereto at the alignment slot 30 is pivoted with respect to the first link assembly 60 into the unlocked position as shown in FIG. 2, such that the sleeve member 110 disengages from the second side 6 of the upright support 10. This allows vertical repositioning of the housing 4 with respect to the upright support 10 in any of an infinite number of locations. When the feet 48 engage the stop 22, no further pivoting is permitted. During normal use, the backrest 13 pivots about the axis 38 while adjusting to the user's back shape and position. The stop 22 prevents the upper member 46 from contacting the upper surface of the second housing 16 and causing separation of the housing members and inadvertent unlocking of the mechanism. When vertical repositioning is completed, the backrest 13 is released and the springs 100 and 101 urge the first and second link assemblies 60 and 64 to assume the locked position, as shown in FIG. 3. The upright support 10 is gripped between the resilient sleeve member 110 and the rod 72, thereby preventing vertical movement of the housing 4 with respect to the upright support 10.

Various features of the invention have been shown and described in connection with the illustrated embodiments of the invention. However, it must be understood that these particular arrangements merely illustrate, and that the invention is to be given the fullest interpretation within the terms of the appended claims.

What is claimed is:

1. A mechanism for vertical adjustability and securement of a backrest of a chair including a housing having a first member and a second member, pivotally attached to each other at one end, said housing defining a passage therethrough adapted to receive the upright support of a chair backrest; a first link assembly disposed within said housing; a second link assembly disposed within said housing and pivotally connected to said first link assembly; said first and second link assemblies movable between a locked position and an unlocked position, said second link assembly engageable with and adjustable by said second housing member; a sleeve member carried by said second link assembly and engageable against the upright support when said first and second link assemblies are in said locked position; a rod carried by said first link assembly and spaced from said sleeve member so as to define a gap therebetween through which the upright support passes; means adapted to connect said second housing member to the chair backrest; resilient biasing means connected between said first link assembly and said second link assembly to urge said first and second link assemblies to assume said locked position, whereby movement of the chair backrest causes said first and second link assemblies to move between said locked and unlocked positions such that when the first and second link assemblies assume a locked position the upright support is gripped between said sleeve member and said rod and when said link assemblies are moved to said unlocked position said second link assembly is pivoted with respect to said first link to increase the gap between said sleeve member and said rod so as to allow vertical repositioning of the housing with respect to the upright support thereby providing vertical adjustability and securement of the chair backrest.

2. A mechanism as in claim 1 wherein said means adapted to connect said second housing member to the chair backrest includes a bracket pivotally connected to said second housing member.

3. A mechanism as in claim 2 in which said bracket includes stop means engageable with said first housing member so as to allow limited pivotal movement of said second housing member with respect to said first housing member.

4. A mechanism as in claim 1 in which a roller member is rotatably carried by said first link assembly to provide for easy vertical adjustability of said housing and backrest with respect to the upright support.

5. A mechanism as in claim 4 including an alignment pin carried by said second link assembly and positionable opposite said roller member to define a gap therebetween, said roller member adapted to lie adjacent the upright support.

6. A mechanism as in claim 1 in which said rod carried by said first link assembly functions as the pivotal connection between said first and second link assemblies.

7. A mechanism as in claim 1 in which said resilient biasing means includes at least one tension spring.

8. A mechanism as in claim 1 in which said second link assembly includes a grooved rod for nonrotatably carrying said sleeve member.

9. A mechanism as in claim 8 in which said second housing member includes a recess having a sloped side for unimpeded movement of said grooved rod when said first and second linkage assemblies are moved between a locked and unlocked position.

* * * * *